US010589282B2

(12) United States Patent
Doppstadt

(10) Patent No.: US 10,589,282 B2
(45) Date of Patent: Mar. 17, 2020

(54) DRUM FOR A CHOPPING DEVICE, IN PARTICULAR A PRECISION CHIPPER

(71) Applicant: DOPPSTADT FAMILIENHOLDING GMBH, Velbert (DE)

(72) Inventor: Johann Doppstadt, Velbert (DE)

(73) Assignee: DOPPSTADT FAMILIENHOLDING GMBH, Velbert (DE)

( * ) Notice: Subject to any disclaimer, the term of this patent is extended or adjusted under 35 U.S.C. 154(b) by 288 days.

(21) Appl. No.: 15/528,118

(22) PCT Filed: Nov. 19, 2015

(86) PCT No.: PCT/EP2015/002315
§ 371 (c)(1),
(2) Date: May 19, 2017

(87) PCT Pub. No.: WO2016/078764
PCT Pub. Date: May 26, 2016

(65) Prior Publication Data

US 2017/0341082 A1 Nov. 30, 2017

(30) Foreign Application Priority Data

Nov. 19, 2014 (DE) ..... 20 2014 009 164 U

(51) Int. Cl.
*B02C 18/00* (2006.01)
*B02C 18/14* (2006.01)
(Continued)

(52) U.S. Cl.
CPC ..... *B02C 18/146* (2013.01); *B02C 18/18* (2013.01); *B27G 13/10* (2013.01); *B27L 11/005* (2013.01)

(58) Field of Classification Search
CPC ..... B02C 18/18; B02C 18/146; B02C 13/10; B27L 11/005
See application file for complete search history.

(56) References Cited

U.S. PATENT DOCUMENTS 269,315 A * 12/1882 Orum ..... B27G 13/14 144/220
5,511,597 A * 4/1996 Shantie ..... B27L 11/005 144/218

(Continued)

FOREIGN PATENT DOCUMENTS

| | | |
|---|---|---|
| DE | 20 2005 017 373 U1 | 5/2006 |
| DE | 10 2005 053 006 B3 | 4/2007 |
| EP | 1 302 288 A2 | 4/2003 |

*Primary Examiner* — Faye Francis
(74) *Attorney, Agent, or Firm* — Jacobson Holman, PLLC.

(57) ABSTRACT

A drum for a precision chipper, said chipping device comprising: a shaft on which the drum is arranged, wherein cutting tools are provided on the outer circumference of the drum in blade holders, which cutting tools are used to chop the material to be chipped; at least one distancing piece, which has a support surface or contact surface for the material to be chipped on the drum, the height of which distancing piece being used to determine the chip size, wherein the vertical position of the distancing piece on the drum can be set or adjusted. The distancing piece, when viewed in cross-section, has an approximately T-shaped form such that it can be placed on the outer edge of the drum disk by means of a positively locking surface of the distancing piece, said surface being formed on the face pointing towards the drum by the inner radius of the distancing piece.

15 Claims, 2 Drawing Sheets

(51) Int. Cl.

| | |
|---|---|
| ***B02C 18/18*** | (2006.01) |
| ***B27L 11/00*** | (2006.01) |
| ***B27G 13/10*** | (2006.01) |

(56) References Cited

U.S. PATENT DOCUMENTS

| | | | | | |
|---|---|---|---|---|---|
| 5,617,908 | A * | 4/1997 | Toogood | B27G 13/12 | 144/218 |
| 5,662,436 | A * | 9/1997 | Bishop | B23C 5/2269 | 407/35 |
| 5,709,255 | A * | 1/1998 | Toogood | B27B 33/20 | 144/220 |
| 5,816,301 | A * | 10/1998 | Stager | B27L 11/005 | 144/228 |
| 6,938,656 | B2 * | 9/2005 | Plouffe | B27L 11/005 | 144/220 |
| 2003/0070728 | A1 * | 4/2003 | Plouffe | B27L 11/005 | 144/220 |

* cited by examiner

DRUM FOR A CHOPPING DEVICE, IN PARTICULAR A PRECISION CHIPPER

BACKGROUND OF THE INVENTION

The invention relates to a drum for a chopping device, in particular a precision chipper, comprising a shaft on which the drum is arranged, wherein at the outer circumference of the drum cutting tools are provided in blade holders serving for chopping the material to be chopped, having at least one distancing piece comprising a support surface or contact surface for the material to be chopped on the drum, the height of which distancing piece determining the chip size of the chopping process.

Drums of this kind are known in precision chippers that have become known either as chopping cylinder, knife drum, flail drum, or chopping drum. These drums are mounted in a housing and can be set for rotational movement. These chopping machines are employed, for example, in forestry for chopping wood scraps. However, they also serve for chopping food or cellulose material. When using precision chippers the focus is on even chips in a certain dimension. Preferably different chip sizes can be produced for different materials to be chopped with one device. In the state of the art it is known that the knives are height-adjustable, i. e. their flight circle can change. Because of the wear of the knives, however, after a short processing time the size of the chips change, and this is not desired. What is also known are precision chippers having a drum with one or more supports serving as a distancing piece or a distance holder for the material to be chopped. However, it is a disadvantage of these devices that the size of the chips cannot be changed. It is another disadvantage of these devices that the distance holder is exposed to a very high wear when used as intended.

In the citation DE 10 2005 053 006 B3 a chopping rotor with adjustable cutting depth is described. As it can already be seen in the drawing, wedge 4 can be height-adjusted continuously. It can be swiveled around an axis. However, the disadvantage of this device is the fact that the chip size can change unintentionally even when used as intended.

BRIEF DESCRIPTION OF THE INVENTION

Therefore it is an object of the invention to suggest a device for chopping material to be chopped that does not have at least one of the before-mentioned disadvantages of the state of the art.

The problem of the invention is solved by a drum for a chopping device, in particular a precision chipper, with a shaft on which the drum is provided, wherein at the outer circumference of the drum cutting tools are provided in knife holders serving for chopping the material to be chopped, with at least one distancing piece comprising a support surface or contact face for the material to be chopped on the drum, the height of which determining the chip size for the chopping process, wherein the level of the distancing piece on the drum can be set or changed, in particular adjusted, wherein the distancing piece is formed, seen in cross-section, roughly T-shaped so that it can be placed on one side with a side of the upper web of the T on the outer edge of the drum disc and the inner radius of the distancing piece, i. e, on a form fitting surface that is formed there. This solution according to the invention allows to provide a device where the chip size for the material to be chopped can be adjusted precisely by adjusting or setting of the at least one distancing piece to a desired size, and in particular to different sizes. Accordingly, one device is enough for realizing different chip sizes of the material to be chopped by using the design of the drum according to the invention. The wear of the knives or cutting tools is also reduced by employing this measurement. According to the invention, two embodiments are comprised by the invention, namely a continuous adjustment as well as an adjustment in steps or notches. Cleverly the invention suggests that the distancing piece is formed like a T, seen in cross-section, so that on one side it can be placed with a side of the upper web of the T on the outer edge of the drum disc and on the inner radius of the distancing piece, i. e. on a form-fitting surface formed there. This design allows that beside the force-fitting link, i. e. the attachment of the distancing piece to the drum disc, additionally a form-fitting connection is provided, namely when the outer edge of the drum disc corresponds with the leg of the T in installed position on the side facing the drum, that means they have identical radii. An unintended change of the chip size is thus reliably prevented.

According to a development the invention the distancing piece is arranged on the drum interchangeably. The advantages of such a configuration are obvious. Besides a possible change because of wear or damage of the distancing piece, this allows also adjusting the distance of the distancing piece to the drum axis. Different distances of the distancing piece can thus be set, resulting in different sizes of the chips.

According to the invention it has been found to be an advantage when the drum is formed by at least two drum discs arranged parallel and spaced on the shaft. The configuration is in particular an advantage as cleverly the cutting tools as well as the distancing pieces can be attached to the drum discs without any problem because of the existing space. Also for maintenance purposes it is favorable when there is a certain space between the single drum discs so that the service staff can get to the cutting tools or the distancing pieces without any problems in the case of maintenance.

According to the invention it has proved advantageously when the drum is configured as a rotor. Accordingly the drum is arranged, e.g. in a housing and mounted there rotating so that it acts as a rotor. It is not decisive here whether the rotor is designed as a compact body carrying the distancing pieces and cutting tools at certain holders, or whether the rotor is provided as disc, and the cutting tools and distancing pieces are provided at the discs. According to a modification of the invention the rotor is formed as compact drum.

As already mentioned, according to the invention it is provided in a favorable development that the blade holders along with the cutting tools and the at least one distancing piece are provided at the drum disc. The resulting advantages have already been described above. It is also an advantage when two distancing pieces and two cutting tools are arranged on each drum disc.

According to another favorable modification of the invention it has proved to be an advantage when the blade holders are designed in several parts consisting of a blade holder bottom, an intermediate piece and a pressure piece, the cutting tool being arranged between the intermediate piece and the pressure piece. By arranging in particular an intermediate piece the cutting feature of the cutting tool can be improved, and at the same time the wear of the knives is reduced. Furthermore, the arrangement of the intermediate piece allows supplying intermediate pieces of different thickness, for example for changing the knife thickness or a quick replacement of the knives when they are worn out. The pressure piece firmly presses the knife on the blade holder bottom along with the intermediate piece so that it cannot be changed when used as intended. The blade holder bottom is attached here firmly, for example by welding, to the drum or the drum disc, while the pressure piece is fastened, for example, by known releasable fastening means to the blade holder bottom.

It is another aspect of the drums according to the invention that the cutting tools and/or distancing pieces of two adjacent drum discs are arranged offset. This is an advantageous design and results in a reduced wear of knives and distancing pieces. It is a particular advantage here when the cutting tools and the distancing pieces of two adjacent drum discs are arranged offset such that during a rotation of the drum the support surface is active before the cutting tools is active or attacks the material to be chopped. This has the decisive advantage that the knives can engage only when the distance is as intended in order to maintain the desired chip size or the desired chopping dimension. Of course, this leads to a longer lifetime of the cutting tools and to a steadier cutting performance of the device altogether.

Accordingly a favorable development of the solution according to the invention is characterized in that the side of the distancing piece placed on the drum disc, i. e. the side of the upper web of the T facing the drum disc in installation position corresponds with the outer radius of the drum disc. Furthermore, the invention suggests that both sides of the upper web are designed offset. Offset means here that, seen from the side, the upper web of the T is on one side positioned lower than on the other. This results in two different form-fitting surfaces.

Additionally the invention provides that the middle web of the T-shaped distancing piece has at least two bore holes interacting with fastening means in order to attach the distancing piece to the drum disc. A safe attachment is here reached by traction.

According to the invention it is also provided that, seen from the side, the upper web of the T-shaped distancing piece tapers sickle-like, preferably in opposite direction of the rotational direction of the drum during the chopping process. This leads to a reduced wear and increases the accuracy of the cutting performance of the chopping device by means of the drum according to the invention.

According to a preferred embodiment of the drum according to the invention it is provided that the middle web of the T-shaped distancing piece has two more bore holes to attach the distancing piece to the drum disc at another level with reference to the center of the drum disc. In a simple manner it is now possible to set at least two different levels of the distancing piece. This is possible, for example, by attaching the distancing piece on the left hand side or the right hand side with relation to the longitudinal extension of the drum to the drum disc. If simultaneously the upper web of the T of the distancing piece is provided at different levels with relation to the center axis of the drum the result will be again a perfect traction that will be supplemented by the form fit of the support of the upper web on the outer edge of the drum disc.

In order to reach a continuous adjusting a development of the invention provides that the bore holes for adjusting the level of the distancing piece are formed as long holes.

A development of the above-described solution is characterized in that the bore hole shaped longitudinally has notches to fix the distancing piece at levels determined by the notches. These notches serve for preventing the distancing piece from shifting in the long hole when exposed to high strain. These notches provide an additional form fit that avoids this reliably. According to the invention these notches can be arranged in the long hole as well as on the side parts of the middle web of the T. Offering an additional form fit is decisive in order to prevent the distancing piece from sliding or shifting.

Another modification of the drum according to the invention suggests that on the support surface a preferably triangular support pre-surface is provided. This allows reducing the wear at the distance holder of the device. Thus the solution according to the invention removes another disadvantage of the state of the art as described in the beginning.

Another improvement of the above-described modification suggests that the support pre-surface has flattened corners. Accordingly, the invention suggests that the support pre-surface is formed as a protection element for the support surface. The above-described measurements altogether serve for further reducing the wear on the support surfaces during the intended use. Another result is an improved protection of the cutting tools of the device.

The invention also refers to a chopping device, in particular a precision chipper with at least one drum according to one of the before-described modifications or embodiments of the invention.

BRIEF DESCRIPTION OF THE DRAWINGS

In the following the invention will be described in detail by means of an example. In the drawings.

DETAILED DESCRIPTION OF THE INVENTION

Figure 1:
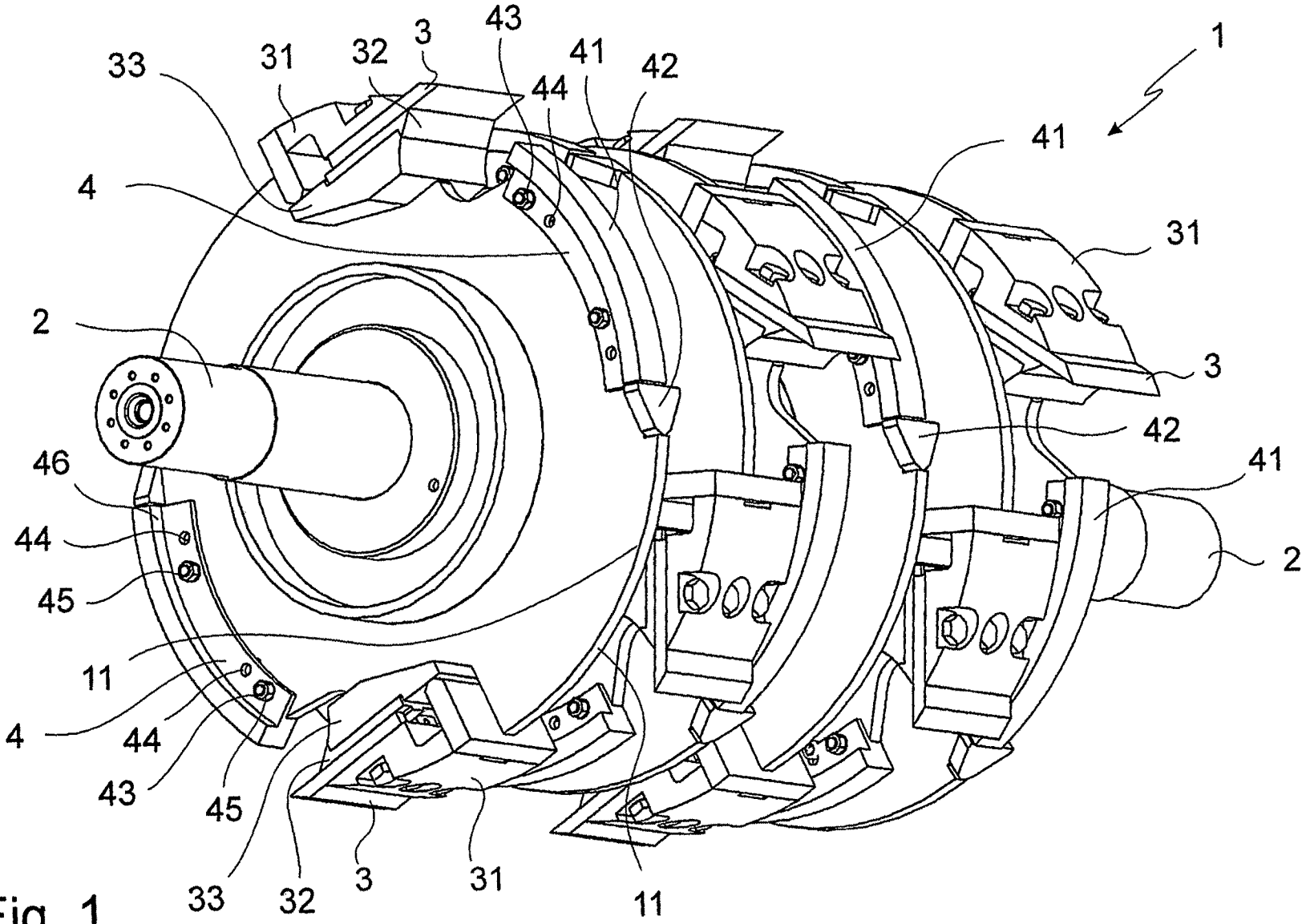
FIG. 1 a front perspective view of an embodiment of the drum according to the invention, and FIG. 2 a front elevational view of the drum shown in FIG. 1.

FIG. 1 shows a three-dimensional representation of an embodiment of the drum 1 according to the invention for the chopping device. It is pointed out that this embodiment in no way restricts the invention, and presents only one of several possible embodiments. Drum 1 is arranged on a shaft 2. In the shown embodiment the drum consists of five drum discs 11 arranged spaced on the shaft 2. Two cutting tools 3 are arranged on each of the drum discs 11 in blade holders 31. The blade holders 31 consist of a blade holder bottom 33, an intermediate piece 32, and a pressure piece 33, the cutting tool 3 being arranged between the intermediate piece 32 and the pressure piece 33. The distancing piece 4 is arranged in cutting direction in front of the cutting tool 3. The distancing piece 4 is configured T-shaped, as can be seen clearly in FIG. 1 in the bottom distancing piece 4. The distancing piece 4 is attached through its middle web on one side to the drum disc 11. Attaching is in bore holes 45 by means of fastening means 43. On the middle web of the T-shaped distancing piece 4 other bore holes 44 are provided. These are provided for the case that the distancing piece 4 should be fastened to the drum disc 11 at another level. This is carried out in a simple manner by fastening the distancing piece 4, after releasing it from the fastening means 43, on the other side of the drum disc 11 in bore holes provided here correspondingly by means of bore holes 44 and the fastening means 43. As it can be seen the upper web of the T is provided offset at different levels, and this is on the side facing the drum discs 11 when used as intended. At the inner radius of the distancing piece 4 form fitting surfaces 46 are provided. The distancing piece 4 has a support surface 41 that is active before the cutting tool 3 is active or attacks the material to be chopped. i.e., the support surface 41 determines the chip size of the material to be chopped. Seen in cutting direction a support pre-surface 42 is provided in front of the support surface 41, the support pre-surface being designed essentially triangularly. This support pre-surface 42 has rounded or flattened corners. The support pre-surface 42 serves as protecting element for the support surface 41.

Figure 2:
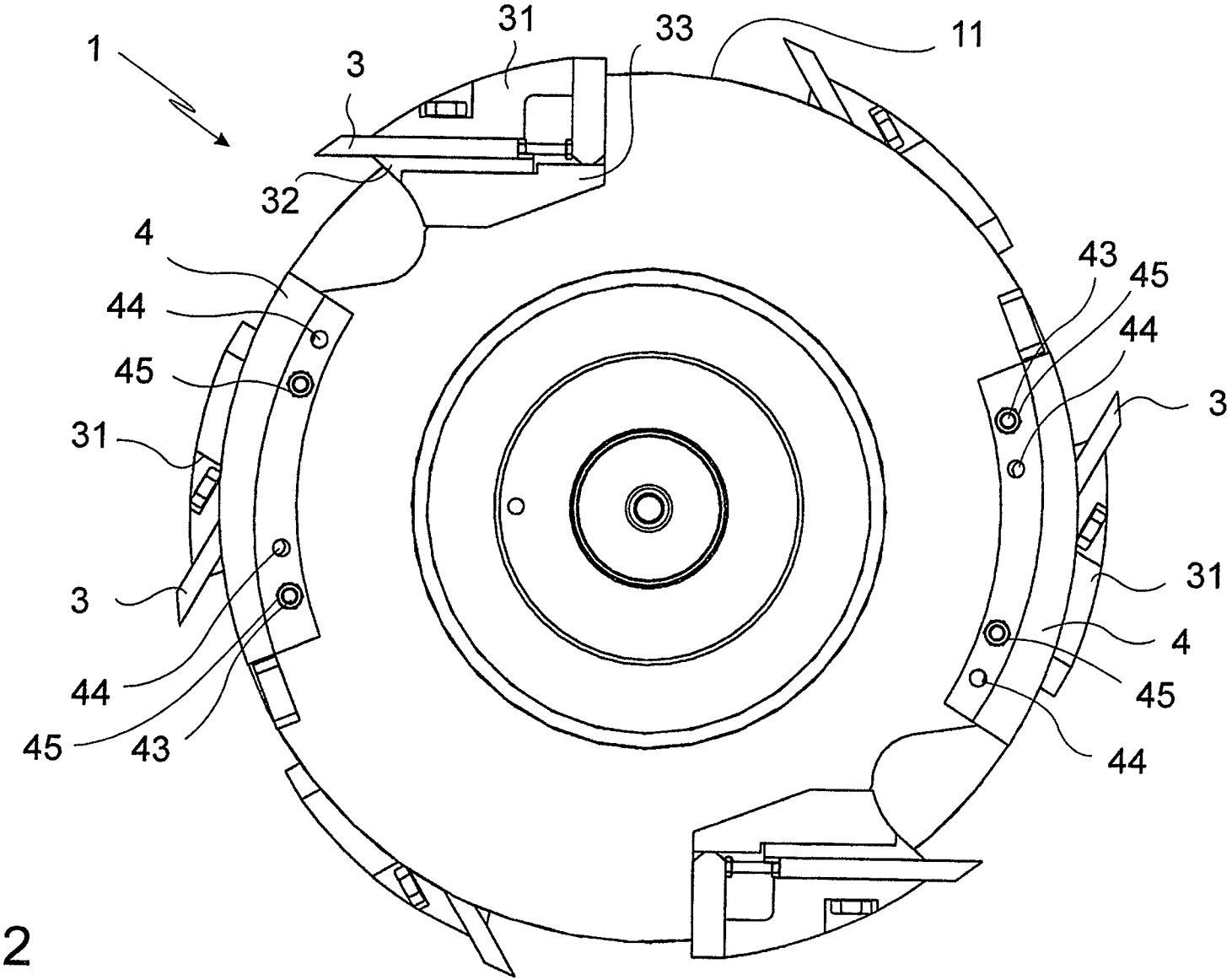

FIG. 2 shows a front view of the drum 1 shown in FIG. 1. The reference numbers presented in FIG. 1 are also used in the same way in this figure for identical features so that a new presentation is not necessary.

The invention has been described before by means of an example. The claims filed now and to be filed later on along with the application are attempted formulations without prejudice for obtaining a-broader protection.

The dependent claims refer to the further embodiment of the subject matter of the main claim by means of the characteristics of the respective dependent claim. However, these are not to be understood as a waiver for obtaining independent, subjective protection for the characteristics of the referred dependent claims.

Characteristics, so far only disclosed in the description, can be claimed in the course of proceedings as being of decisive inventive relevance in the claims, for example to distinguish from the state of the art.

The invention claimed is:

1. A drum for a precision chipper comprising a shaft and at least two discs arranged in parallel on the shaft, cutting tools are provided on outer circumferences of the discs in blade holders, and elongated distancing pieces each having a supporting surface or contact surface on outer circumferences of the discs, height of the discs determining a chip size for a chipping process, wherein a level of the distancing pieces on the discs can be set or changed, wherein the distancing pieces, seen in cross-section transversely to longitudinal extensions of the distancing pieces, are configured T-shaped with an upper web having two form fitting surfaces corresponding with an outer radius of the outer circumferences of the drum discs, wherein the form fitting surfaces are displaced to each other, so that the distancing pieces can be placed on the outer circumferences of the discs in two different height positions relative to central axes of the discs by the form-fitting surfaces.

2. The drum according to claim 1, wherein the distancing piece is arranged on the drum such that the distancing piece can be replaced.

3. The drum according to claim 2, wherein the distancing piece is a deflector.

4. The drum according to claim 1, wherein the drum is configured as a rotor.

5. The drum according to claim 1, wherein the blade holders along with the cutting tools and the distancing pieces on each disc.

6. The drum according to claim 1, wherein the blade holders are configured in several parts, consisting of a blade holder bottom, an intermediate piece, and a pressure piece, wherein the cutting tool is arranged between the intermediate piece and the pressure piece, two distancing pieces and two cutting tools are arranged on each disc.

7. The drum according to claim 1, wherein the cutting tools or the distancing pieces of two adjacently arranged drum discs are arranged offset.

8. The drum according to claim 1, wherein a side of the distancing piece that is placed on the disc which is a side of the upper web the distancing piece facing in mounted position the disc, corresponds with an outer radius of the disc.

9. The drum according to claim 7, wherein a middle web of the distancing piece has at least two bore holes interacting with fasteners for fastening the distancing piece on the disc.

10. The drum according to claim 9, wherein the middle web of the distancing piece has two other bore holes in order to attach the distancing piece the disc at another level with reference to a center of the disc.

11. The drum according to claim 1, wherein bore holes at a middle web of the distancing pieces interacting with fasteners for fastening the distancing pieces on associated disc, and wherein the bore holes for height adjustment of the distancing piece are configured as elongated holes.

12. The drum according to claim 11, wherein the bore holes have notches for fixing the distancing piece at levels defined by the notches.

13. The drum according to claim 1, wherein a triangularly configured support pre-surface is provided on the support surface.

14. The drum according to claim 13, wherein the support pre-surface has flattened corners, and the support pre-surface is a protecting element for the support surface.

15. A precision chipper with at least one drum according to claim 1.

* * * * *